US010010993B2

(12) United States Patent
Xue et al.

(10) Patent No.: US 10,010,993 B2
(45) Date of Patent: Jul. 3, 2018

(54) ROTARY TYPE WHEEL DEBURRING DEVICE

(71) Applicant: CITIC Dicastal CO.,LTD, Qinhuangdao (CN)

(72) Inventors: Bowen Xue, Qinhuangdao (CN); Jiandong Guo, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 56 days.

(21) Appl. No.: 15/383,365

(22) Filed: Dec. 19, 2016

(65) Prior Publication Data

US 2017/0182615 A1 Jun. 29, 2017

(30) Foreign Application Priority Data

Dec. 29, 2015 (CN) ..... 2015 1 1006533

(51) Int. Cl.
*B24B 9/04* (2006.01)
*B24B 29/00* (2006.01)
*B24B 29/04* (2006.01)

(52) U.S. Cl.
CPC ..... *B24B 9/04* (2013.01); *B24B 29/005* (2013.01); *B24B 29/04* (2013.01)

(58) Field of Classification Search
CPC ..... B24B 9/04; B24B 29/00; B24B 29/005
USPC ..... 451/234, 294, 49, 51, 591
See application file for complete search history.

(56) References Cited

U.S. PATENT DOCUMENTS 4,550,464 A * 11/1985 Messing ..... B60S 3/042 15/53.4
9,724,796 B2 * 8/2017 Xue ..... B24B 9/04
9,833,873 B2 * 12/2017 Xue ..... B24B 29/005
2002/0142708 A1 * 10/2002 Bilinovich, Sr. ..... B24B 5/44 451/49

* cited by examiner

*Primary Examiner* — Robert Rose
(74) *Attorney, Agent, or Firm* — Calfee, Halter & Griswold LLP

(57) ABSTRACT

The present invention relates to a rotary type wheel deburring device, which comprises servo motors, cylinders, a brush, etc. When in use, a wheel reaches middle positions of four clamping wheels, a clamping cylinder enables the four clamping wheels to clamp the wheel and separate the wheel from a roller way surface through upper gears and gear racks, and a servo motor I enables the wheel to rotate in a clamped state; a servo motor II enables the brush to rotate; and a servo motor III can be used for adjusting the brush to an appropriate angle in the circumferential direction through a lower gear and a geared ring.

1 Claim, 5 Drawing Sheets

ROTARY TYPE WHEEL DEBURRING DEVICE

CROSS-REFERENCE TO RELATED APPLICATIONS

This application claims priority to Chinese Patent Application No. 201511006533.1, filed on Dec. 29, 2015, which is hereby incorporated by reference in its entirety.

TECHNICAL FIELD

The present invention relates to a deburring device, and in particular to a rotary type wheel deburring device.

BACKGROUND ART

In aluminum-alloy wheel production enterprises, a deburring procedure is indispensable after machining, and if the deburring procedure is omitted, too many burrs remain and will directly affect the painting effect of a follow-up procedure. At present, the wheel deburring mode is that two rotary disc brushes, i.e., an upper rotary disc brush and a lower rotary disc brush are used for removing burrs of a front surface and a back cavity separately; and this mode has a still permissible effect on a majority of wheel types, however, for some wheel types with high requirements and some wheel types with complicated shapes, some parts cannot meet requirements due to this removal mode, so that aiming at shape characteristics of wheel windows, multi-functional deburring equipment is required to be researched and developed, thereby carrying out focused processing on the parts with difficult-to-remove burrs.

SUMMARY OF THE INVENTION

An object of the present invention is to provide a rotary type wheel deburring device which can be used for rapidly adjusting angles of horizontal and circumferential directions of a brush and can be used for carrying out targeted processing on burrs of focal parts.

In order to achieve the object described above, a technical solution of the present invention is as follows: a rotary type wheel deburring device is composed of a machine frame, guide posts, guide sleeves, a bottom plate, a rising and falling plate, guide rails I, a lower sliding plate, guide rails II, a servo electric cylinder I, an upper sliding plate, lower bearing blocks, thrust bearings, revolving rings, a geared ring, a servo electric cylinder II, a guide rail III, a top plate, a sliding block, a link, a lower belt pulley, a supporting plate, an upper guide rail, a left sliding plate, upper bearing blocks, shafts I, clamping wheels, a synchronizing belt, a flipping plate, a brush, a shaft II, an upper belt pulley, a minor bearing block, upper gears, gear racks, a servo motor I, a right sliding plate, a clamping cylinder, a servo motor II, a lower gear, a servo motor III, lifting cylinders and a servo electric cylinder III.

Four guide sleeves and two lifting cylinders are fixed on the bottom plate. Four guide posts matched with the guide sleeves are fixed below the rising and falling plate. Output ends of the lifting cylinders are hinged below the rising and falling plate. The lower sliding plate is mounted above the rising and falling plate through the guide rails I. The upper sliding plate is mounted above the lower sliding plate through the guide rails II. The servo electric cylinder I is fixed at the left side of the lower sliding plate, and an output end of the servo electric cylinder I is connected with the upper sliding plate. The lower bearing blocks are fixed above the upper sliding plate. The thrust bearings are mounted inside the lower bearing blocks. Outer rings of the revolving rings are fixed at top ends of the lower bearing blocks, and inner rings of the revolving rings are fixed at top ends of the thrust bearings. The upper end of the geared ring is fixedly provided with the top plate, and the lower end of the geared ring is fixed at top ends of the inner rings of the revolving rings. The lower gear is mounted at an output end of the servo motor III fixed at the right side of the upper sliding plate and is engaged with the geared ring. The servo electric cylinder III is fixed on the rising and falling plate, and an output end of the servo electric cylinder III is connected with the lower sliding plate.

The lower end of the flipping plate is hinged above the top plate. The sliding block is mounted above the top plate through the guide rail III. The servo electric cylinder II is fixed at the left side of the top plate, and an output end of the servo electric cylinder II is connected with the sliding block. The two ends of the link are separately hinged to the sliding block and the flipping plate. The servo motor II, of which an output end is provided with the lower belt pulley, is fixed at the lower end of the flipping plate. The minor bearing block is fixed at the upper end of the flipping plate. The shaft II which is simultaneously provided with the brush and the upper belt pulley is mounted inside the minor bearing block through a bearing. The lower belt pulley and the upper belt pulley are connected through the synchronizing belt.

The left sliding plate and the right sliding plate are mounted above the supporting plate through the upper guide rail. Two gear racks are fixed below each of the left sliding plate and the right sliding plate, and two upper bearing blocks are fixed above each of the left sliding plate and the right sliding plate. The gear racks are engaged with the upper gears fixed above the supporting plate. The shafts I, of which upsides are fixedly provided with the clamping wheels, are separately fixed inside the four upper bearing blocks through bearings. The servo motor I is fixed at the lower end of the right sliding plate, and an output end of the servo motor I is connected with one of the shafts I. The clamping cylinder is fixed at the right side of the machine frame, and an output end of the clamping cylinder is connected with the right sliding plate.

During actual use, a wheel reaches middle positions of four clamping wheels, the clamping cylinder enables the four clamping wheels to clamp the wheel and separate the wheel from a roller way surface through the upper gears and the gear racks, and the servo motor I enables the wheel to rotate in a clamped state; the servo motor II enables the brush to rotate, the servo electric cylinder I is used for adjusting the brush to an appropriate position through the guide rails II, then, the lifting cylinders are used for jacking up the brush through the guide posts, burrs of root corners of flanges can be removed when the brush is in contact with the root corners of the flanges, and burrs of roots of rims can be removed after the servo electric cylinder II is used for adjusting the brush to an appropriate horizontal angle through the guide rail III; and the servo motor III can be used for adjusting the brush to an appropriate angle in the circumferential direction through the lower gear and the geared ring, meanwhile, the servo electric cylinder III is used for adjusting the brush to an appropriate position through the guide rails I, the brush is enabled to rotate along a tangential direction of rotation of burrs of root included angles of the flanges, and the burrs of the root included angles of the flanges can be rapidly removed when the brush is in contact with the burrs of the root included angles of the flanges.

When in use, the rotary type wheel deburring device can be used for rapidly adjusting the angles of the horizontal and circumferential directions of the brush and can be used for carrying out targeted processing on the burrs of the focal parts; and meanwhile, the rotary type wheel deburring device has the characteristics of simple structure, high degree of automation, advanced technology, high universality, high efficiency and safe and stable performance.

Figure 1:
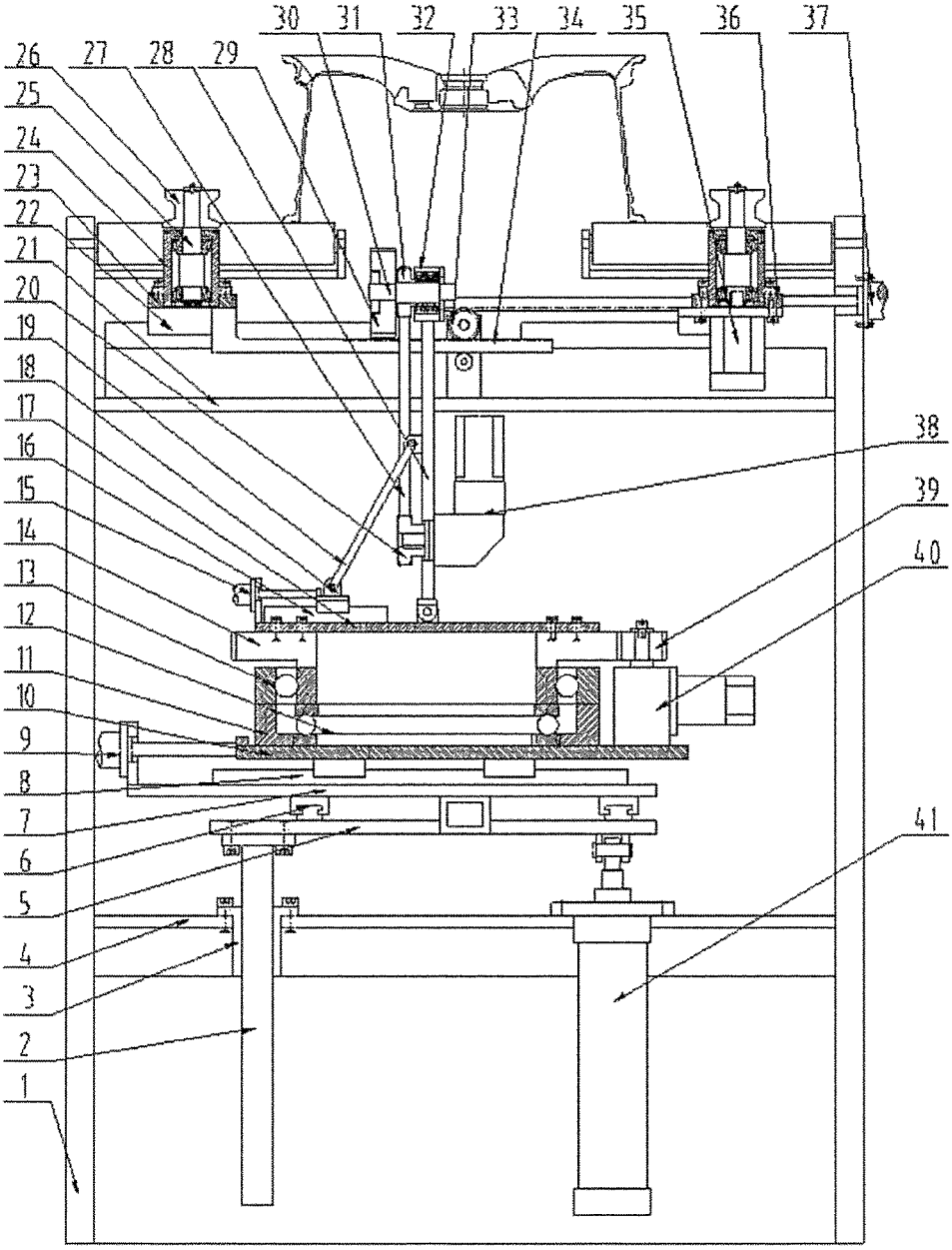
FIG. 1 is a front view of a rotary type wheel deburring device provided by the present invention.
Figure 2:
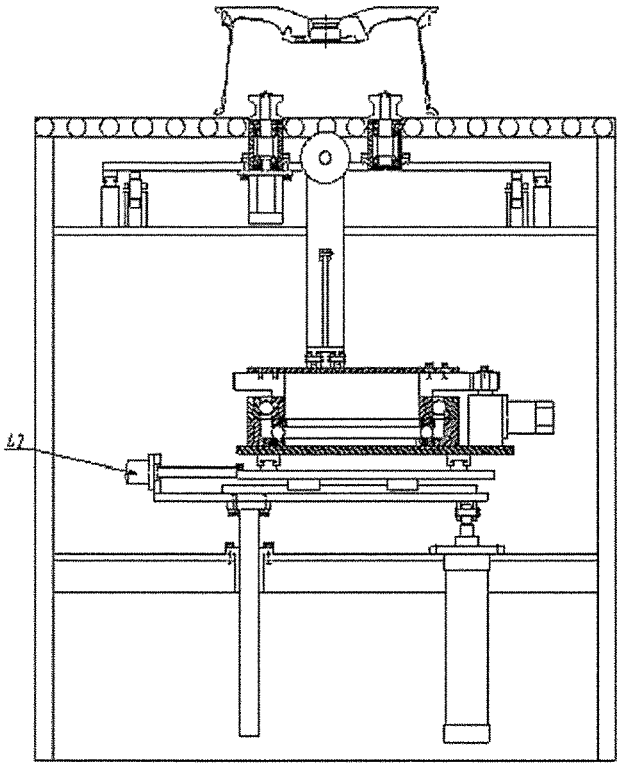
FIG. 2 is a left view of a rotary type wheel deburring device provided by the present invention.
Figure 3:
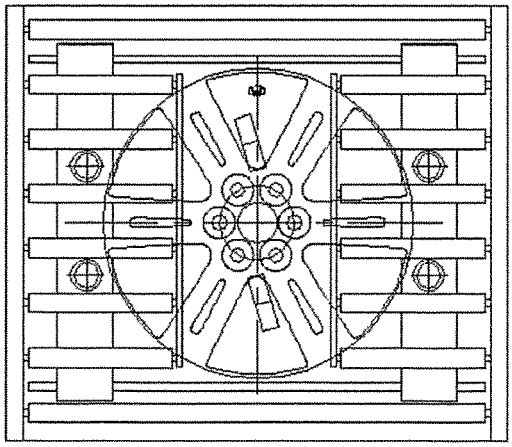
FIG. 3 is a top view of a rotary type wheel deburring device provided by the present invention.
Figure 4:
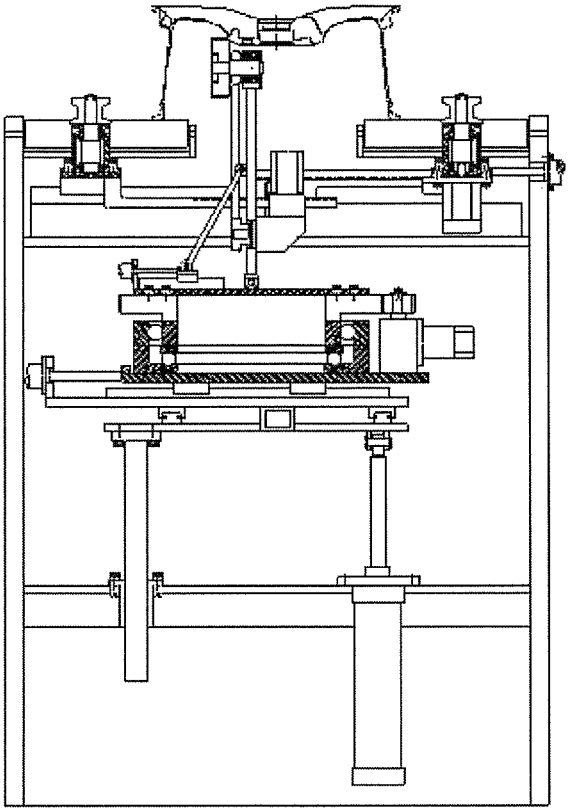
FIG. 4 is a front view of a rotary type wheel deburring device provided by the present invention during removing of burrs of roots of flanges.
Figure 5:
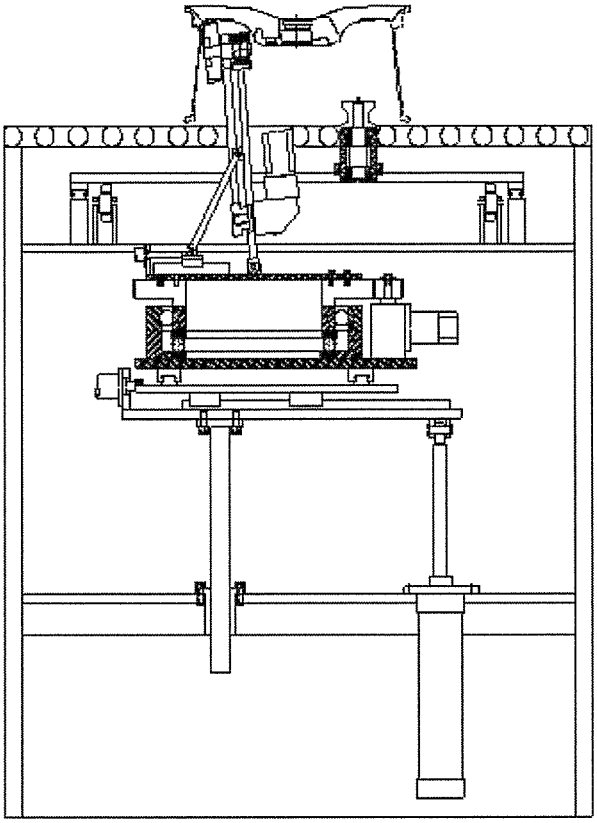
FIG. 5 is a left view of a rotary type wheel deburring device provided by the present invention during removing of burrs of roots of rims.
Figure 6:
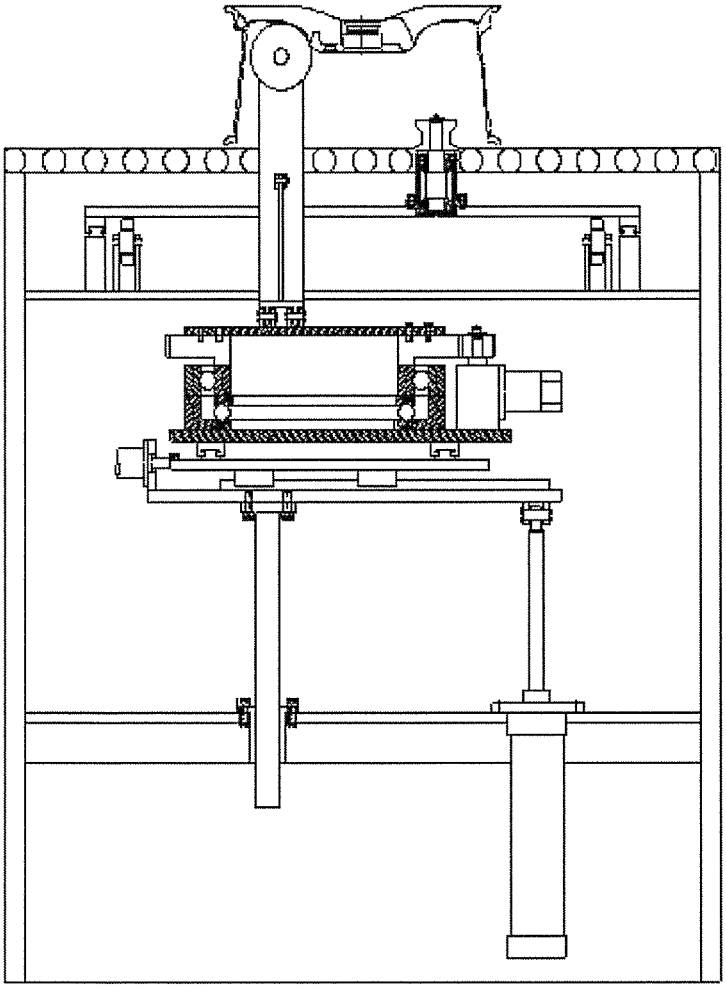
FIG. 6 is a left view of a rotary type wheel deburring device provided by the present invention during removing of burrs of root included angles of flanges.

In the figures, numeric symbols are as follows: 1—machine frame, 2—guide post, 3—guide sleeve, 4—bottom plate, 5—rising and falling plate, 6—guide rail I, 7—lower sliding plate, 8—guide rail II, 9—servo electric cylinder I, 10—upper sliding plate, 11—lower bearing block, 12—thrust bearing, 13—revolving ring, 14—geared ring, 15—servo electric cylinder II, 16—guide rail III, 17—top plate, 18—sliding block, 19—link, 20—lower belt pulley, 21—supporting plate, 22—upper guide rail, 23—left sliding plate, 24—upper bearing block, 25—shaft I, 26—clamping wheel, 27—synchronizing belt, 28—flipping plate, 29—brush, 30—shaft II, 31—upper belt pulley, 32—minor bearing block, 33—upper gear, 34—gear rack, 35—servo motor I, 36—right sliding plate, 37—clamping cylinder, 38—servo motor II, 39—lower gear, 40—servo motor III, 41—lifting cylinder and 42—servo electric cylinder III.

DETAILED DESCRIPTION OF THE INVENTION

In the following, the details and working conditions of a specific device provided by the present invention are described in combination with the figures.

A rotary type wheel deburring device is composed of a machine frame 1, guide posts 2, guide sleeves 3, a bottom plate 4, a rising and falling plate 5, guide rails I 6, a lower sliding plate 7, guide rails II 8, a servo electric cylinder I 9, an upper sliding plate 10, lower bearing blocks 11, thrust bearings 12, revolving rings 13, a geared ring 14, a servo electric cylinder II 15, a guide rail III 16, a top plate 17, a sliding block 18, a link 19, a lower belt pulley 20, a supporting plate 21, an upper guide rail 22, a left sliding plate 23, upper bearing blocks 24, shafts I 25, clamping wheels 26, a synchronizing belt 27, a flipping plate 28, a brush 29, a shaft II 30, an upper belt pulley 31, a minor bearing block 32, upper gears 33, gear racks 34, a servo motor I 35, a right sliding plate 36, a clamping cylinder 37, a servo motor II 38, a lower gear 39, a servo motor III 40, lifting cylinders 41 and a servo electric cylinder III 42. Four guide sleeves 3 and two lifting cylinders 41 are fixed on the bottom plate 4. Four guide posts 2 matched with the guide sleeves 3 are fixed below the rising and falling plate 5. Output ends of the lifting cylinders 41 are hinged below the rising and falling plate 5. The lower sliding plate 7 is mounted above the rising and falling plate 5 through the guide rails I 6. The upper sliding plate 10 is mounted above the lower sliding plate 7 through the guide rails II 8. The servo electric cylinder I 9 is fixed at the left side of the lower sliding plate 7, and an output end of the servo electric cylinder I 9 is connected with the upper sliding plate 10. The lower bearing blocks 11 are fixed above the upper sliding plate 10. The thrust bearings 12 are mounted inside the lower bearing blocks 11. Outer rings of the revolving rings 13 are fixed at top ends of the lower bearing blocks 11, and inner rings of the revolving rings 13 are fixed at top ends of the thrust bearings 12. The upper end of the geared ring 14 is fixedly provided with the top plate 17, and the lower end of the geared ring 14 is fixed at top ends of the inner rings of the revolving rings 13. The lower gear 39 is mounted at an output end of the servo motor III 40 fixed at the right side of the upper sliding plate 10 and is engaged with the geared ring 14. The servo electric cylinder III 42 is fixed on the rising and falling plate 5, and an output end of the servo electric cylinder III 42 is connected with the lower sliding plate 7.

The lower end of the flipping plate 28 is hinged above the top plate 17. The sliding block 18 is mounted above the top plate 17 through the guide rail III 16. The servo electric cylinder II 15 is fixed at the left side of the top plate 17, and an output end of the servo electric cylinder II 15 is connected with the sliding block 18. Two ends of the link 19 are separately hinged to the sliding block 18 and the flipping plate 28. The servo motor II 38, of which an output end is provided with the lower belt pulley 20, is fixed at the lower end of the flipping plate 28. The minor bearing block 32 is fixed at the upper end of the flipping plate 28. The shaft II 30 which is simultaneously provided with the brush 29 and the upper belt pulley 31 is mounted inside the minor bearing block 32 through a bearing. The lower belt pulley 20 and the upper belt pulley 31 are connected through the synchronizing belt 27.

The left sliding plate 23 and the right sliding plate 36 are mounted above the supporting plate 21 through the upper guide rail 22. Two gear racks 34 are fixed below each of the left sliding plate 23 and the right sliding plate 36, and two upper bearing blocks 24 are fixed above each of the left sliding plate 23 and the right sliding plate 36. The gear racks 34 are engaged with the upper gears 33 fixed above the supporting plate 21. The shafts I 25, of which upsides are fixedly provided with the clamping wheels 26, are separately fixed inside the four upper bearing blocks 24 through bearings. The servo motor I 35 is fixed at the lower end of the right sliding plate 36, and an output end of the servo motor I 35 is connected with one of the shafts I 25. The clamping cylinder 37 is fixed at the right side of the machine frame 1, and an output end of the clamping cylinder 37 is connected with the right sliding plate 36.

During work, a wheel reaches middle positions of the four clamping wheels 26, the clamping cylinder 37 enables the four clamping wheels 26 to clamp the wheel and separate the wheel from a roller way surface through the upper gears 33 and the gear racks 34, and the servo motor I 35 enables the wheel to rotate in a clamped state. The servo motor II 38 enables the brush 29 to rotate, the servo electric cylinder I 9 is used for adjusting the brush 29 to an appropriate position through the guide rails II 8, then, the lifting cylinders 41 are used for jacking up the brush 29 through the guide posts 2, burrs of root corners of flanges can be removed when the brush 29 is in contact with the root corners of the flanges, and burrs of roots of rims can be removed after the servo electric cylinder II 15 is used for adjusting the brush 29 to an appropriate horizontal angle through the guide rail III 16. The servo motor III 40 can be used for adjusting the brush 29 to an appropriate angle in the circumferential direction through the lower gear 39 and the geared ring 14, meanwhile, the servo electric cylinder III 42 is used for adjusting the brush 29 to an appropriate position through the guide rails I 6, the brush 29 is enabled to rotate along a tangential direction of rotation of burrs of root included angles of the flanges, and the burrs of the root included angles of the flanges can be rapidly removed when the brush 29 is in contact with the burrs of the root included angles of the flanges.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A rotary type wheel deburring device, which is composed of a machine frame, guide posts, guide sleeves, a bottom plate, a rising and falling plate, guide rails I, a lower sliding plate, guide rails II, a servo electric cylinder I, an upper sliding plate, lower bearing blocks, thrust bearings, revolving rings, a geared ring, a servo electric cylinder II, a guide rail III, a top plate, a sliding block, a link, a lower belt pulley, a supporting plate, an upper guide rail, a left sliding plate, upper bearing blocks, shafts I, clamping wheels, a synchronizing belt, a flipping plate, a brush, a shaft II, an upper belt pulley, a minor bearing block, upper gears, gear racks, a servo motor I, a right sliding plate, a clamping cylinder, a servo motor II, a lower gear, a servo motor III, lifting cylinders and a servo electric cylinder characterized in that four guide sleeves and two lifting cylinders are fixed on a bottom plate; four guide posts matched with the guide sleeves are fixed below the rising and falling plate; output ends of the lifting cylinders are hinged below the rising and falling plate; the lower sliding plate is mounted above the rising and falling plate through the guide rails I; the upper sliding plate is mounted above the lower sliding plate through the guide rails II; the servo electric cylinder I is fixed at the left side of the lower sliding plate, and an output end of the servo electric cylinder I is connected with the upper sliding plate; the lower bearing blocks are fixed above the upper sliding plate; the thrust bearings are mounted inside the lower bearing blocks; outer rings of the revolving rings are fixed at top ends of the lower bearing blocks, and inner rings of the revolving rings are fixed at top ends of the thrust bearings; the upper end of the geared ring is fixedly provided with the top plate, and the lower end of the geared ring is fixed at top ends of the inner rings of the revolving rings; the lower gear is mounted at an output end of the servo motor III fixed at the right side of the upper sliding plate and is engaged with the geared ring; and the servo electric cylinder III is fixed on the rising and falling plate, and an output end of the servo electric cylinder III is connected with the lower sliding plate;

the lower end of the flipping plate is hinged above the top plate; the sliding block is mounted above the top plate through the guide rail III; the servo electric cylinder II is fixed at the left side of the top plate, and an output end of the servo electric cylinder II is connected with the sliding block; two ends of the link are separately hinged to the sliding block and the flipping plate; the servo motor II, of which an output end is provided with the lower belt pulley, is fixed at the lower end of the flipping plate; the minor bearing block is fixed at the upper end of the flipping plate; the shaft II which is simultaneously provided with the brush and the upper belt pulley is mounted inside the minor bearing block through a bearing; and the lower belt pulley and the upper belt pulley are connected through the synchronizing belt; and the left sliding plate and the right sliding plate are mounted above the supporting plate through the upper guide rail; two gear racks are fixed below each of the left sliding plate and the right sliding plate, and two upper bearing blocks are fixed above each of the left sliding plate and the right sliding plate; the gear racks are engaged with the upper gears fixed above the supporting plate; the shafts I, of which upsides are fixedly provided with the clamping wheels, are separately fixed inside the four upper bearing blocks through bearings; the servo motor I is fixed at the lower end of the right sliding plate, and an output end of the servo motor I is connected with one of the shafts I; and the clamping cylinder is fixed at the right side of the machine frame, and an output end of the clamping cylinder is connected with the right sliding plate.

* * * * *